US005475764A

United States Patent [19]

Polk

[11] Patent Number: 5,475,764

[45] Date of Patent: Dec. 12, 1995

[54] BANDPASS WOOFER AND METHOD

[75] Inventor: Matthew S. Polk, Baltimore, Md.

[73] Assignee: Polk Investment Corporation, Wilmington, Del.

[21] Appl. No.: 294,532

[22] Filed: Aug. 23, 1994

Related U.S. Application Data

[63] Continuation-in-part of Ser. No. 954,697, Sep. 30, 1992, abandoned.

[51] Int. Cl.[6] ..... H04R 25/00

[52] U.S. Cl. ..... 381/159; 381/154; 181/160

[58] Field of Search ..... 381/159, 153, 381/154, 158, 88, 90, 162, 59; 181/145, 148, 155, 156, 160, 199

[56] References Cited

U.S. PATENT DOCUMENTS 4,284,860 8/1981 Leach, Jr. et al. ..... 381/159

5,009,281 4/1991 Yokoyama et al. ..... 381/159

5,147,986 9/1992 Cockrum et al. ..... 181/199

*Primary Examiner*—Curtis Kuntz

*Assistant Examiner*—Huyen D. Le

*Attorney, Agent, or Firm*—Snell & Wilmer

[57] ABSTRACT

A single-vented bandpass woofer loudspeaker system design and method for enabling operation in smaller enclosure volumes with only moderate loss of efficiency. The bandpass system has an enclosure with a partition dividing it into a first sealed chamber and a second chamber having a passive radiating port communicating with air outside the enclosure. A driver is mounted in the partition. Novel, empirically determined tuning ratios which depend upon system variables are defined. By adjusting the system variables to keep the tuning ratios within empirically determined values, a good relationship between flat response, bandwidth and efficiency is achieved. Unexpectedly, using a higher than normal moving mass of the driver leads to an acceptable system with a very small enclosure volume.

22 Claims, 4 Drawing Sheets

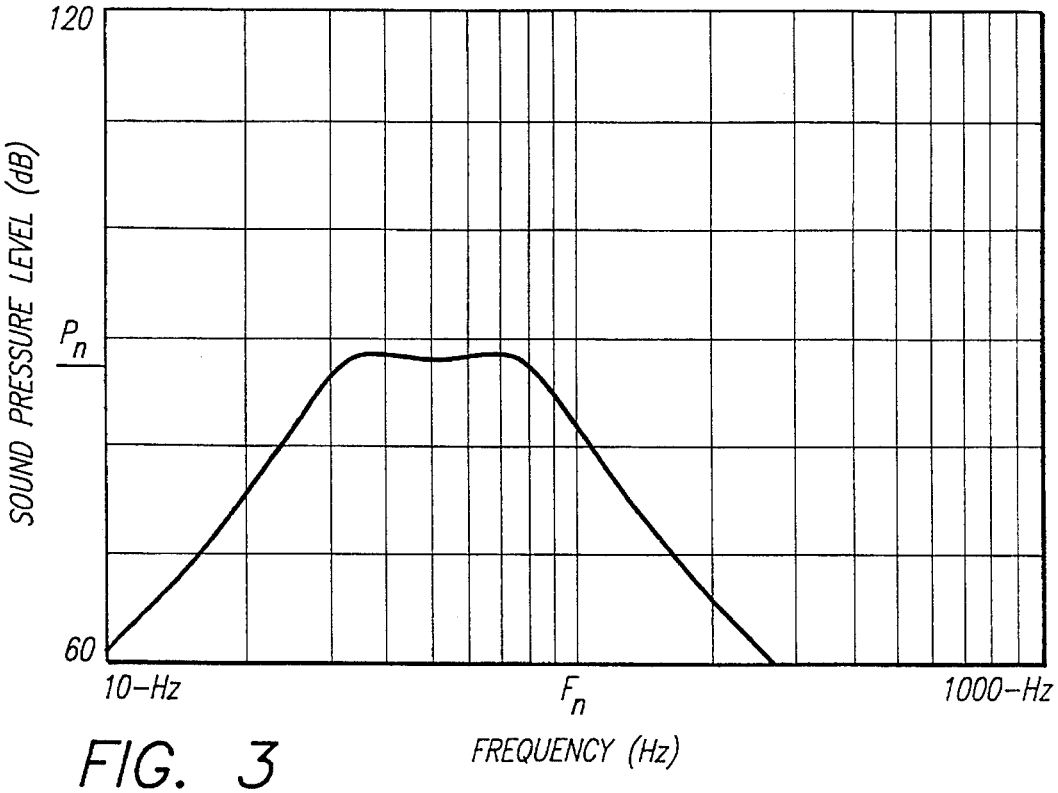
FIG. 3
FIG. 6
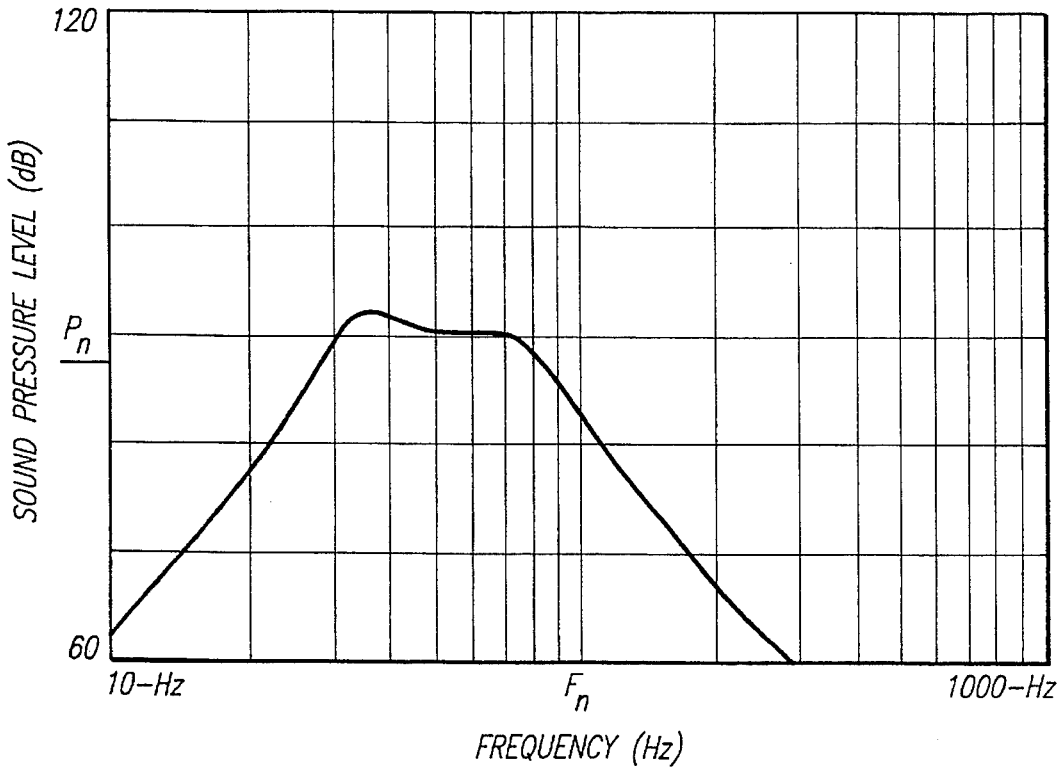

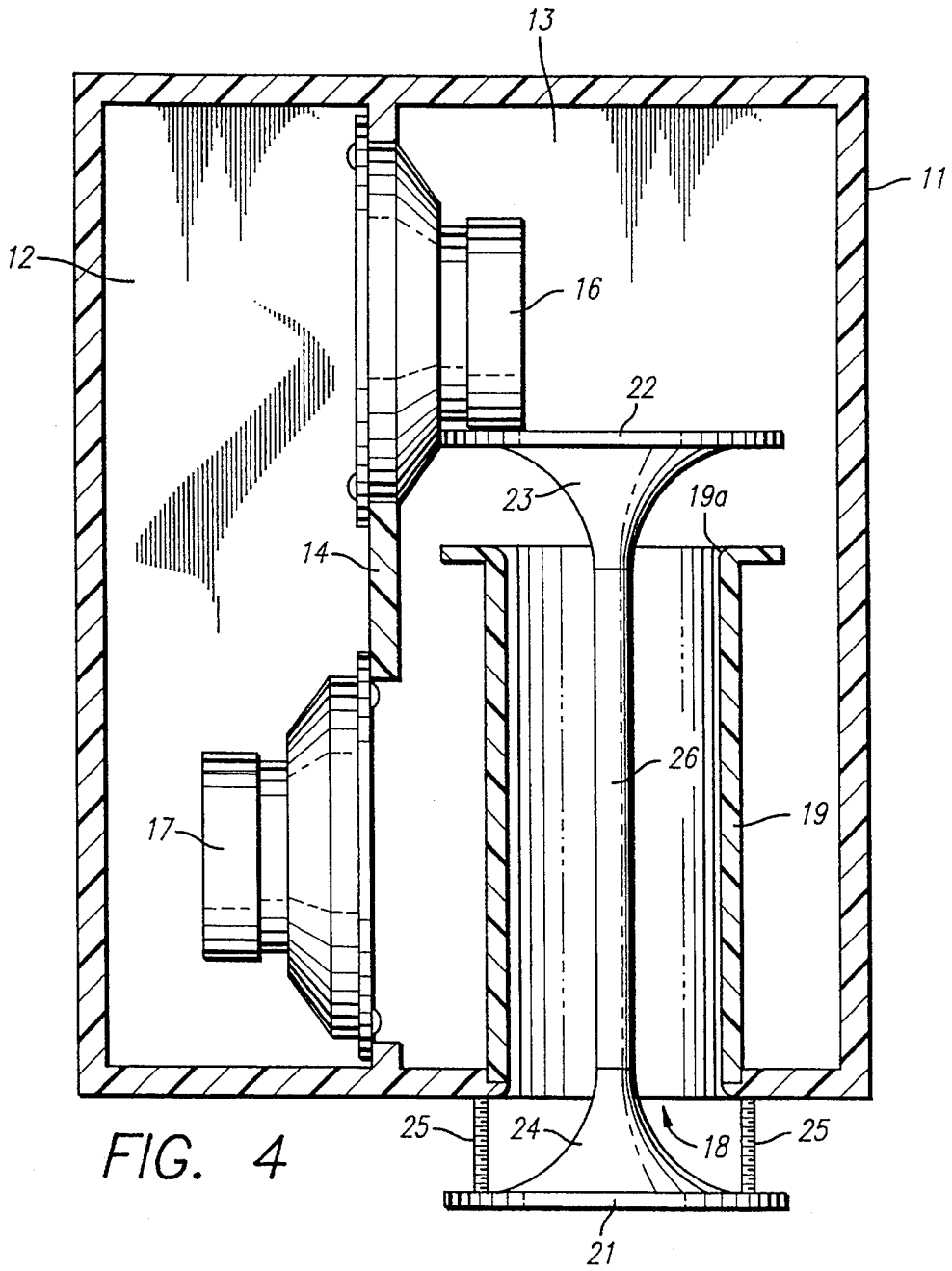
FIG. 4
FIG. 5
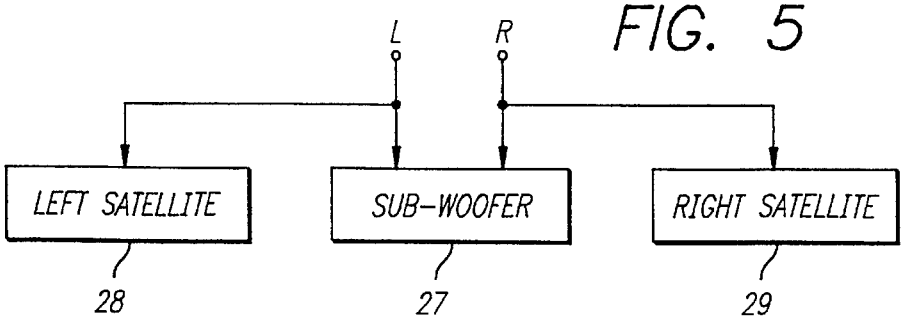

BANDPASS WOOFER AND METHOD

CROSS REFERENCE TO RELATED APPLICATIONS

This application, to the extent of common subject matter and concepts, is a continuation-in-part of application Ser. No. 07/954,697, filed Sep. 30, 1992, for Bandpass Sub-Woofer Having Paired Face-to-Face Drivers, now abandoned.

FIELD OF THE INVENTION

This invention relates to a bandpass woofer loudspeaker and method of configuring same, and in particular relates to such a loudspeaker and method optimized to be of very small size with little compromise in efficiency.

BACKGROUND OF THE INVENTION

Bandpass type woofers have come to be generally well accepted, and have become somewhat popular as a means for producing reasonable amounts of bass from relatively small enclosures with good efficiency. However, it has taken a long time for this type of woofer to receive serious consideration.

The basic idea for a bandpass woofer has been known since the first part of this century. Even double vented bandpass enclosures (such as the original AM-5 produced by Bose Corporation) are discussed in the 1934 U.S. Pat. No. 1,969,704, issued to A. D'Alton. But it was really not until the 1970's, after the work of Thiele and Small, that any serious attention was paid to bandpass type woofers. A summary of their work is set forth in "*Loudspeakers in Vented Boxes*" by A. N. Thiele, a multipart series which appeared in the *Journal of the Audio Engineering Society,* Vol. 19, pp. 382–392 (May 1971) and "*Vented-Box Loudspeaker Systems*" by Richard H. Small also a multipart series which appeared in the *Journal of The Audio Engineering Society.* Thereafter a paper presented to the Audio Engineering Society Convention in Los Angeles, May 15–18, 1979 by Louise Fincham, entitled *A Bandpass Loudspeaker Enclosure,* set forth a good basis for analyzing bandpass system response. Since then numerous papers and articles have appeared discussing the subject in greater or less depth. Notable among the various papers is the very thorough paper by Earl Geddes and David Fawcett presented at the Audio Engineering Society Convention in Los Angeles in November 12–16, 1986, entitled *Bandpass Loudspeaker Enclosures.* The Geddes and Fawcett paper discusses solutions for 4th through 8th order bandpass systems.

With the theoretical tools in place, as discussed above, the availability of powerful personal computers and workstations has made it possible to analyze and specify complicated bandpass woofer designs. However, the inherent higher cost and narrow bandwidth of these systems as compared to standard ported or acoustic suspension designs limited their appeal until 3-piece or sub-woofer satellite systems became popular in the late 1980's. The appeal of these new sub-woofer satellite systems lies mainly in the small size and utility of the satellites. A bandpass sub-woofer offers the perfect complement to these small satellites in that it is a relatively compact sub-woofer with a sharp high-frequency cut-off which desirably minimizes localizability of the sub-woofer. Due in part to the popularity of 3-piece systems, recent years have seen a multitude of variations on the basic bandpass scheme. These include double-vented systems, where both cavities are vented directly to the outside air; internally double-vented systems, where the second cavity is vented into the first which is, in turn, vented to the outside; triple cavity systems where two cavities share a drive unit which is vented into a third cavity which is, in turn, vented to the outside; and so on.

Although these new variations are interesting and offer potential, recent research and experimentation has revealed that the potential of the basic single vented bandpass woofer has not been fully exploited. Additionally, the single-ended acoustic nature of a single vented bandpass system gives it a significant advantage over double-vented bandpass and normal vented woofer systems in both its ability to benefit from room gain and in reduced sensitivity to room placement. Additionally, the growing popularity of home theater systems has made self-powered sub-woofers a virtual requirement for high quality home systems. However, market research has shown that virtually all consumers who have brought self-powered sub-woofers would like them to be smaller. The opportunity to design the amplifier and woofer system together offers interesting possibilities, and allows reevaluating the question of size versus efficiency in sub-woofers. In particular, the cost differential to obtain a slightly more powerful amplifier may be offset entirely by the cost savings of a smaller enclosure.

OBJECTS AND SUMMARY OF THE INVENTION

It is an object of the present invention to provide a bandpass type woofer loudspeaker system tuned to operate in small enclosure volumes.

It is a further object to provide such a bandpass type woofer loudspeaker system wherein the small enclosure volume involves only a moderate loss of efficiency.

It is a still further object of the present invention to provide such a bandpass type woofer loudspeaker system incorporating a novel port geometry allowing practical realization of loudspeaker tunings requiring vents with large acoustic mass in a relatively small space.

Briefly, in accordance with one embodiment of the invention, a bandpass woofer loudspeaker system includes an enclosure which has a partition dividing it into a first chamber and a second chamber. The first chamber is sealed, and the second chamber has a passive radiating element, port or vent communicating with air outside the enclosure. A driver which is a transducer of the type having a diaphragm with front and rear sides is mounted in the partition. Tuning ratios are defined, establishing relationships among a plurality of variables which include the moving mass of the driver, the resonance of the driver in the first sealed chamber, the acoustic moving mass of the driver, the acoustic compliance of the driver suspension and the first sealed chamber, the acoustic resistance of the moving coil of the driver, the acoustic mass of the passive radiating element or port, and the acoustic compliance of the second chamber having the passive radiating port. By adjusting the values of these variables to keep the tuning coefficients within empirically determined values, a good relationship between flat response, bandwidth and efficiency are achieved. Unexpectedly, it has been found that in accordance with the invention, using a higher than normal moving mass and Bl product of the driver leads to an acceptable bandpass woofer system with a very small enclosure volume.

In accordance with one embodiment of the bandpass woofer system, a novel passive radiating port geometry is used to minimize port size and reduce audible acoustic turbulence.

Other objects and advantages of the invention will appear from the accompanying drawings taken in conjunction with the following detailed description.

BRIEF DESCRIPTION OF THE DRAWINGS

FIG. 3 is a frequency response curve of a bandpass woofer system in accordance with the present invention, in which tuning ratios among variables of the system have been constrained within predetermined value limits, which results in a response curve equivalent to that of the system of FIG. 2 from a system having an enclosure volume only a fraction of that of FIG. 2.

FIG. 4 is a sectional view of a bandpass woofer system in accordance with the present invention using, in this case, two drivers.

FIG. 5 is a diagram of a sub-woofer/satellite system in accordance with one aspect of the invention.

FIG. 6 is the calculated response curve for the system shown in FIG. 4.

DETAILED DESCRIPTION OF THE PREFERRED EMBODIMENT

Reference is made to a co-pending patent application, Ser. No. 07/764,335, filed Sep. 30, 1992, for an invention in Band Pass Sub-Woofer Having Paired Face-to-Face Drivers, now abandoned. The disclosure of that co-pending patent application is hereby incorporated by reference. In accordance with the invention described in that patent application, a small, highly efficient band-pass woofer is constructed by using drivers with very high moving mass in a small sealed enclosure. The drivers are connected in such a way as to give an unusually high Bl product to control the high moving mass. This creates essentially what can be described as an over-damped motor system coupled to an under-damped mechanical and acoustic system. The composite result is a properly damped system where the high moving mass is used to allow a reduction in the volume of the sealed chamber that would otherwise be required for a given resonant frequency of the driver in the sealed chamber.

In additional research and development work building upon what is disclosed in the above-referenced co-pending patent application, it has been found that a series of tuning ratios controlling the interrelationship among the variables can be defined for a single vented bandpass system. If the tuning ratios are kept in a range of empirically determined values, a group of woofer tunings is obtained with highly desirable characteristics. These desirable characteristics include a very small size enclosure for a given low frequency extension, a very small size enclosure for a given dynamic range, a high ratio of efficiency versus bandwidth, a flat response with easily controllable tilt of the response curve if desired, and easily selectable trade-offs between size and efficiency.

Figure 1:
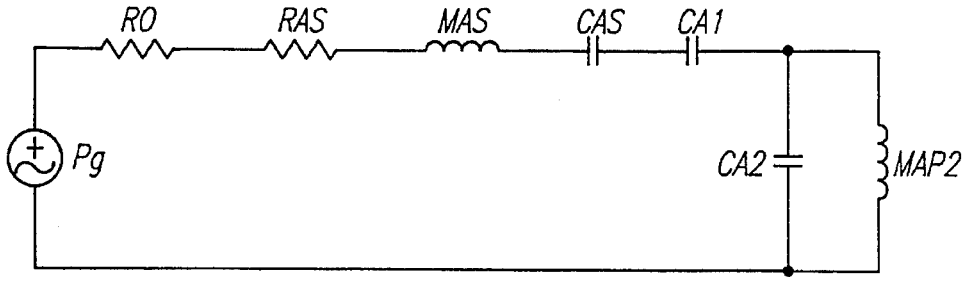
FIG. 1 is an analogous acoustic circuit diagram representing a single vented bandpass woofer system.

As with any acoustical device, an analogous or equivalent circuit diagram can be drawn which represents the acoustic performance of the system. FIG. 1 is such an acoustical equivalent circuit diagram which represents a single vented bandpass woofer system. In FIG. 1, $P_g$ refers to an acoustic pressure generator, which represents basically a conversion of the electric power going into the system to acoustic pressure. As to the other elements shown in FIG. 1, R0 is the acoustical representation of the driver voice coil resistance, RAS is the acoustical representation of the mechanical losses in the driver, MAS represents the acoustical moving mass of the driver and the air mass it is pushing around, and CAS is the acoustical representation of the suspension stiffness of the driver. The representations shown as CA1 and CA2 are, respectively, representations of the stiffness of the air in the sealed and vented chambers. Finally, MAP2 is the acoustic representation of the acoustic mass of air in the port or vent.

The acoustic component labels used herein should be familiar to those skilled in the art and who have worked with acoustic analogous circuits. For definitions of the variables and formulas for calculating acoustic values of components, reference may be had to "Acoustics"; Leo L. Beranek; Mass. Institute Technology; Bolt Beranek and Newman Inc.; Cambridge Mass.; McGraw Hill Book Co. 1954.

In the equivalent circuit of FIG. 1, the acoustic response may be calculated by analyzing the circuit and is proportioned to the current flow through equivalent inductor MAP2 (acoustic mass of the port) multiplied by the frequency.

Analysis of the circuit of FIG. 1 gives the following equation for the acoustic response of the system in dB SPL (sound pressure level) relative to Pref=0 dB SPL where Pref is defined as $2\times10^{-5}$ newton $m^{-2}$:

$$P_n = 20\log\left[\left|\frac{1}{Pref\cdot c}\;\frac{kA\,(s_n)^2}{B\cdot(s_n)^4 + C\cdot(s_n)^3 + D\cdot(s_n)^2 + E\cdot s_n + 1}\right|\right] \tag{1}$$

where $c=344.8\ m.sec^{-1}$ $\rho=1.18\ kg.m^{-3}$ $k=1i(\rho)(c/2\pi r)$ where r is the distance from the measuring microphone to the sound source $s_n$=the complex array of discrete frequencies Further mathematical analysis of the circuit of FIG. 1 and the polynomial equation (1) (See the paper entitled "Bandpass Loudspeaker Enclosure" by Geddes and Fawcett referred to above) yields the following for the polynomial coefficients of equation (1):

The coefficients:

A=CAT.[Eg.B1/((Rg+Re).Sd)]

B=CAT.MAS.CA2.MAP2

C=CA2.MAP2.CAT.(R0+RAS)

D=CA2.MAP2+CAT.MAP2+CAT.MAS

E=CAT.(R0+RAS)

The following variables will be used throughout and will be familiar to those skilled in the art. (See "Acoustics" by Beranek referred to above):

Eg=amplifier output voltage

Rg=amplifier source voltage
Bl=driver motor force factor
Re=driver voice-coil DC resistance
Sd=driver cone area
Mmd=moving mass of the driver in kilograms
Cms=compliance of driver suspension
Rms=mechanical loss of driver
V1=volume of sealed chamber
V2=volume of vented chamber
Sp2=cross-sectional area of port
t2=length of port
fs =free-air resonance of driver
fc=the resonance of the driver in the sealed cavity
fp=resonance of port mass against vented chamber
CAT=combined acoustic compliance of driver suspension and sealed cavity
MAS=acoustic moving mass of driver
RAS=acoustic mechanical loss of driver
CA2=acoustic compliance of vented cavity
MAP2=acoustic mass of vent
R0=the acoustic resistance of the voice coil defined as:

$$R0=[(Bl^2/Sd^2)/(Rg+Re)]$$

In accordance with the present invention, and based on empirical experiments and observations, three tuning ratios for a bandpass single-vented woofer are defined as follows:

$$Q_{mc}=\frac{Mmd\cdot fc}{\text{kg}\cdot\text{sec}^{-1}} \tag{2}$$

$$Q_{tc}=\left(\frac{MAS}{CAT}\right)^{.5}\cdot\frac{1}{R0} \tag{3}$$

$$Q_{tp}=\left(\frac{MAP2}{CA2}\right)^{.5}\cdot\frac{1}{R0} \tag{4}$$

All of the tuning ratios defined in equations (2) through (4) are unusual and unobvious in that they exclude all mechanical losses. For example, those skilled in the art typically use a quantity called the system total Q or $Q_t$ in defining a "quality factor" for a single vented woofer. Qt is typically calculated as follows:

$$Q_t=\left(\frac{MAS}{CAT}\right)^{.5}\cdot\frac{1}{R0+RAS} \tag{5}$$

where RAS is the mechanical loss in the driver.

The tuning ratio $Q_{tc}$ in accordance with the present invention and as defined in equation (3) is similar except for the exclusion of RAS. $Q_{tp}$ is the same thing except it uses acoustic values for mass and compliance of the vented chamber instead of the driver moving mass and compliance of the sealed chamber. $Q_{mc}$ essentially captures the ratio of moving mass to sealed chamber volume, normalized against 1 mechanical ohm (1 kg/sec).

It has been found experimentally that when $Q_{tc}$=1.0, $Q_{tp}$=1.0, and fc=fp, a good relationship exists among the variables of a single-vented woofer such that flat response, good bandwidth and efficiency are achieved. Specifically, bandwidth is approximately 1.5 octaves to the 3dB down points on the response curve.

It has also been found that a single vented bandpass system in accordance with this invention and with the proper relationship among the system variables in accordance with this invention, can be completely determined by specifying or choosing values for $Q_{tc}$, $Q_{tp}$, $Q_{mc}$, fc, fp, Sd, Cms and Re. Given these variables, the remaining system parameters, Bl, Mmd, V1, V2 and MAP2 are determined in accordance with the principles of this invention and using the tuning ratios defined above. Furthermore, it has been determined that the size versus efficiency trade-off for a given tuning frequency, fc, is completely determined by the tuning ratio $Q_{mc}$ by itself.

The manner in which the tuning ratios and teachings of this invention can be employed to determine the relationship among the variables for a single—vented bandpass woofer will now be explained in connection with FIGS. 2 and 3. First, referring to FIG. 2, a frequency response curve is shown for a typical example of a single-vented bandpass loudspeaker system as has been known in the prior art. The example for which the response curve is shown in FIG. 2 uses a single 10 inch driver in a single—vented enclosure, and has the following parameters:

| Driver | |
|---|---|
| Bl = 6.755 weber · $m^{-1}$<br>Cms = .000510 m · $newton^{-1}$<br>Sd = .035 $m^2$<br>Re = 4 ohm<br>Mmd = .030 kg<br>fs = 38.363 Hz<br>Rms = 1.707 kg · $sec^{-1}$<br>fc = 50.001 Hz | |
| Port | Cabinet |
| Sp2 = 14 $in^2$<br>t2 = 6.212 in<br>fp = 49.997 Hz | (Sealed) V1 = 3.731 $ft^3$<br>(Vented) V2 = 1.69 $ft^3$ |

Figure 2:
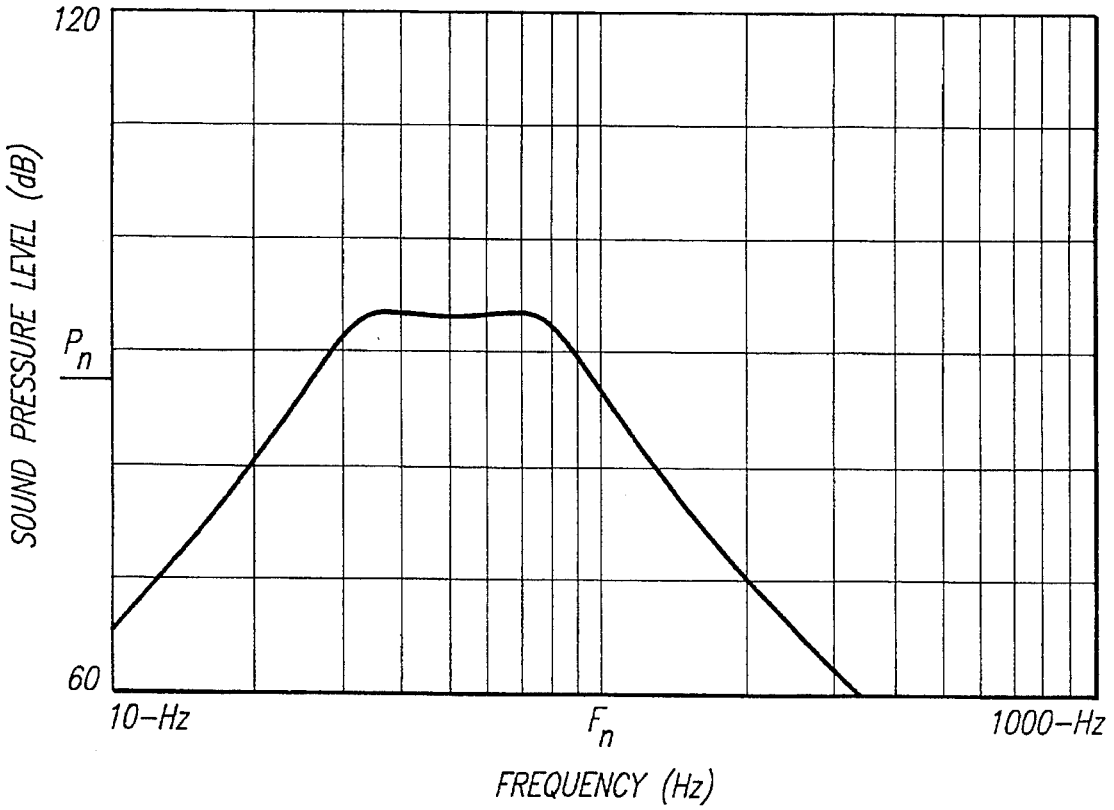
FIG. 2 is a frequency response curve of a typical single vented bandpass woofer system using a single 10-inch driver, as has been constructed in the past.

It will be apparent to those skilled in the art that the driver parameters set forth above and used to achieve the response of FIG. 2 are typical for a drive unit of this size. Although this configuration appears to produce a desirable response curve as shown in FIG. 2, the total cabinet size of over 5.4 cubic feet represents a serious practical problem. For the sake of comparison to the example discussed hereafter, if the tuning coefficients defined in accordance with the present invention are calculated for the system with the parameters discussed above, the results are as follows:

$Q_{tc}$=1

$Q_{mc}$=1.5

$Q_{tp}$=1

Turning now to a consideration of FIG. 3, there is shown a frequency response curve for a system using a 10 inch driver similar to the example discussed above, but in which the tuning ratio $Q_{mc}$ in accordance with the present invention has been set equal to 5.0, while holding fc=fp=50 Hz, $Q_{tc}$=$Q_{tp}$=1, and holding Sd, Cms and Re the same values as in the example whose response is shown in FIG. 2.

The parameters for the thus configured system, and with their relationships determined by the tuning ratios in accordance with the invention, are as follows:

| Driver | |
|---|---|
| Bl = 11.558 weber · $m^{-1}$<br>Cms = .000510 m · $newton^{-1}$<br>Sd = . 035 $m^2$<br>Re = 4 ohm<br>Mmd = .100 Kg<br>fs = 21.88<br>fc = 49.996 Hz | |
| Port | Cabinet |
| Sp2 = 14 $in^2$<br>t2 = 23.432 in<br>fp = 50.009 Hz | (Sealed) V1 = 0.71 $ft^3$<br>(Vented) V2 = 0.577 $ft^3$ |

As set forth above, the tuning coefficients used to determine the Bl product, Mmd and cabinet volume V1 and V2 were $Q_{tc}$=1, $Q_{mc}$=5, and $Q_{tp}$=1.

The response curve in FIG. 3 is generally the same as that of FIG. 2, but the total cabinet volume is dramatically reduced—to less than 1.3 cubic feet. The loss in efficiency shown by FIG. 3 versus FIG. 2 is only about 4.4 dB. However, the new driver parameters as determined in accordance with the tuning ratios are required for Mmd and Bl. As will be apparent to those skilled in the art, a Bl product of 11.558 weber.$m^{-1}$ is somewhat high for a 10 inch driver, but not unheard of. However, moving mass (Mmd) of 100 grams for a 10 inch driver is far outside the normal range of specification by those skilled in the art. Such a combination of parameters together with the enclosure specifications are highly unusual, and not at all obvious or intuitive. It is not believed that anyone skilled in the art would arrive at these parameters and specifications without the detailed analysis and experimentation which has led to the development of the new tuning ratios set forth herein, namely $Q_{mc}$, $Q_{tc}$ and $Q_{tp}$, and their appropriate range of values.

The Bl and Mmd driver parameters required in the above example, while they can be realized in practice, do not fall within the ordinary parameters for a 10 inch driver available from driver suppliers—it is necessary to fabricate a custom driver having these parameters. In fact, without the ability to custom fabricate drivers with the unusual parameters as discussed herein, one would be unlikely to perceive the need for and would not even be able to perform the experiments that have led to the analysis herein and definition of desired values for the three novel tuning ratios defined herein.

The tuning ratio $Q_{mc}$ can be thought of as a measure of how compressed the cabinet volumes are in the system. In general, and as is clear from the definition of $Q_{mc}$, higher values of $Q_{mc}$ lead to higher moving mass and higher Bl product, but smaller cabinet volumes. In the example of FIG. 3 even larger values of $Q_{mc}$ predict the possibility of reducing cabinet volumes even further. However, at some point values for the driver parameters, such as Mmd and Bl, would become impractically large. Nevertheless, systems with a higher tuning frequency, fc, or a larger diaphragm area, Sd, can, in general, use much higher values of $Q_{mc}$ than systems with a lower tuning frequency without requiring impractically large values for Mmd or Bl product.

It has been found experimentally that single-vented bandpass loudspeaker systems having fc approximately equal to fp, and values for the tuning ratios $Q_{tc}$ and $Q_{tp}$ between 0.75 and 1.25 approximate the desirable response characteristics shown in FIG. 2 and 3. This desirable response characteristic can be defined as being no more than −2 dB down at the center of the pass band relative to the highest points of the response curve and covering a range of at least 1.25 octaves between the −3 dB points. It has also been importantly determined on an experimental basis for such systems tuned to operate in the usual range for woofer or sub-woofer loudspeakers, i.e., generally below 100 Hz, that when such a system, in addition, has a tuning ratio $Q_{mc}$, as defined herein, greater than 5.0, the system is characterized by unusually high values for moving mass and Bl product of the driver relative to the driver cone size combined with unusually small enclosure volumes relative to driver cone size and tuning frequency. In particular, it has been importantly determined on an experimental basis that systems where the tuning ratio, $Q_{mc}$, is greater than 1/10th of the tuning frequency, fc, and where the diaphragm area is less than approximately 0.050 sq. meters, are characterized by unusually high values for moving mass and Bl product of the driver relative to the driver cone size combined with unusually small enclosure volumes relative to driver cone size and tuning frequency. Systems employing larger diaphragm areas have also been found, on an experimental basis, to be characterized by unusually high values for moving mass and Bl product when the value of the tuning ratio, $Q_{mc}$, is portionately greater than for a system using a 0.050 sq. meter diaphragm. For example, a system with a diaphragm area of 0.100 sq. meters would exhibit unusually large values of moving mass and Bl product for values of the tuning ratio, $Q_{mc}$, greater than 2/10th's the value of the tuning frequency, fc.

Variations are possible in the frequency response curve of a single-vented bandpass loudspeaker in accordance with the invention. For example, by varying the ratio of fc to fp, the frequency response curve will be tilted up in the direction of fp while maintaining the benefits of small size and efficiency. That is, if fp is greater than fc, then the higher frequency side of the pass band will be tilted up. Conversely, if fp is made less than fc, then the lower frequency side of the pass band will be tilted up. It has been experimentally determined that values of the ratio fc/fp greater than 0.75 and less than 1.25 produce useful characteristics when coupled to the above specified values for $Q_{tc}$, $Q_{tp}$ and $Q_{mc}$ in accordance with the present invention.

In accordance with a further aspect of this invention, an arrangement has been discovered for matching the so-called "speed" of a bandpass woofer to smaller loudspeakers intended to operate over a range of higher frequencies. This relates to a common application of bandpass woofers in systems with two or more smaller "satellites" designed to reproduce the frequency range above that reproduced by the woofer. One of the most difficult problems in designing these systems is to make the sub-woofer and satellites reproduce their respective frequency ranges in such a way as to sound like a single homogeneous source covering the combined frequency range of the sub-woofer plus the satellite. The typical prior art approach to this problem has been to create complementary frequency response curves in the satellite and sub-woofer such that the combination of the two exhibits flat frequency response over the combined range. Typically, however, this does not produce a homogeneous sounding source. The reasons for this are not completely understood. Nevertheless, in accordance with the present invention it has been experimentally found that sub-woofer/satellite systems with approximately flat combined frequency response do sound much more like a single homogeneous source when the $Q_{tc}$ of the bandpass woofer is less than 1.25 and lies within the range of greater than 75% but less than 110% of the $Q_{tc}$ of the satellite. Recent development work suggests that the combined impulse response of systems having matched $Q_{tc}$'s more closely resembles the impulse response of a single homogenous system with bandwidth equal to the combined range of the sub-woofer plus satellites and having a similar Q.

In applying the principles of the present invention to configuring single-vented woofers in small size enclosures, a practical problem is encountered. Specifically, the required acoustic mass of the port, MAP2, is often quite high for the values of woofer tuning ratios in accordance with the present invention. In addition, due to the low frequency response and dynamic range of systems in accordance with the present invention, the calculated volumes of air which must move in the port are quite large. These considerations suggest a large diameter port to minimize turbulence by reducing the velocity of air flow. However, the port length must increase as the square of the port diameter to maintain the same acoustic mass. In the case of the example discussed in connection with FIG. 3, a two ft. long 4¼ inch diameter port was used. Experiments have shown, however, that this diameter is too small and exhibits audible turbulence. A 6 inch diameter port would be adequate but would have to be nearly 4.5 ft. long to maintain the same acoustic mass, an impractically large length given the goal of providing a small size enclosure.

A co-pending patent application, Ser. No. 08/177,080, filed Jan. 4, 1994 and entitled Ported Loudspeaker System and Method discloses an invention which addresses and solves the problem of achieving the necessary acoustic mass of air in the port using a smaller diameter port without introducing unacceptable port noise and turbulence. The disclosure of co-pending application Ser. No. 08/177,080 is hereby incorporated by reference. Simply described, the invention of that application provides a technique to achieve, in a vented system, the same operation as would be provided by a flared, directed port, but with several performance advantages and a much simpler, lower cost of implementation. This is achieved through provision of a port in the loudspeaker baffle, with the necessary acoustic mass to achieve a desired tuning frequency being provided by one or more disks or baffle plates of a predetermined size being provided more or less concentric to and adjacent the port but spaced therefrom by a predetermined distance. This creates a duct with in essence a flared cross-section at either end which offers no straight-line path from the air volume inside the cabinet to the air outside the cabinet.

In another co-pending application, filed of even date herewith and entitled Ported Loudspeaker System and Method with Reduced Air Turbulence, and which is a continuation-in-part of the earlier application filed Jan. 4, 1994, there are disclosed and claimed further improvements in port geometry. Specifically, shaped air guides which may be in a configuration of an inverted circular funnel with concave sides are added to the disks or baffle plates to block areas that otherwise would have non-laminar air flow and serve to further reduce air turbulence and noise. The disclosures of this co-pending patent application filed of even date herewith are incorporated by reference.

Now that the basic precepts of the present invention have been discussed, a preferred embodiment will be described. Turning to a consideration of FIG. 4, there is shown a cross sectional drawing of a single-vented bandpass loudspeaker system in accordance with the present invention. In the system shown in FIG. 4, two 10 inch drivers are used. The present invention is equally applicable to use of one or multiple drivers, identical or non-identical, wired in series or parallel. For multiple drivers, certain driver parameters or variables discussed herein, such as cone area, moving mass, etc., are simply the sum for the multiple drivers. Other driver parameters such as suspension compliances, are calculated as the product of the multiple suspension compliances divided by their sum. Electrical parameters, such as voice—coil resistance, obey the normal rules for combining electrical resistances according to whether the drive units are wired in series or in parallel. The combined Bl product for multiple identical drive units when connected in parallel is the same as for a single drive unit. When connected in series, the combined Bl product is the simple sum of the multiple drivers so connected whether they are identical or not. The combined Bl product for parallel connected, non-identical drive units may not be meaningful unless analyzed in the acoustic domain.

Referring to FIG. 4, there is provided an enclosure 11 which is divided into two chambers 12 and 13 by a partition 14. Two drivers 16 and 17 of a moving coil transducer type are mounted in the partition 14. In the example shown in FIG. 4 the two drivers are mounted such that the front cone surface of driver 16 opens into chamber 12 and the front cone surface of driver 17 opens into the chamber 13. This is not essential, however, in accordance with the invention. As an alternative when using multiple drivers, they may all open into one or the other of the two chambers.

As shown in FIG. 4, the chamber 12 is sealed, and the chamber 13 is provided with a passive radiating port generally indicated by reference numeral 18, formed by port or vent tube 19 provided within the chamber 13. In accordance with the principles and features disclosed in the above-referenced two co-pending patent applications related to port geometry, the system of FIG. 4 is provided with disks 21 and 22 provided at either end of the port with flow guides 23 and 24 for blocking areas where otherwise there would be stagnant or non-laminar air flow. In FIG. 4 the two flow guides 23 and 24 are joined by a connector 26 which channels the flow of air through the port through a donut-like cylindrical cross-section. The disks, flow guides and connector can be suitably mounted by small struts 25 to the enclosure structure in a manner such as to not to significantly interfere with air flow. As shown in FIG. 4, the port or vent tube 19 is provided with rounded edges at its ends, e.g. **19*a*, having a radius concentric with the curvature of flow guides 23 and 24, so as to insure smooth laminar air flow through the port. The port arrangement shown in FIG. 4** creates a port structure whose cross-sectional area increases smoothly from a minimum in the center of the port or vent tube to a larger cross section at either end and whose flow characteristics remain more or less constant with higher volume velocities of flow. As a result, the possibility of air turbulence and noise is greatly reduced.

The actual parameters or variables of the system shown in FIG. 4 are as follows:

| Driver | |
|---|---|
| Bl = 14.72 weber · $m^{-1}$<br>Cms = .000263 m · $newton^{-1}$<br>Sd = .0648 $m^2$<br>Re = 4.04 ohm<br>Mmd = .170 Kg<br>fs = 23.168 Hz<br>fc = 53.622 Hz | |
| Port | Cabinet |
| Sp2 = 48 $in^2$<br>t2 = 39.6 in | (Sealed) V1 = 1.2 $ft^3$<br>(Vented) V2 = 1.26 $ft^3$ |

-continued

| |
|---|
| fp = 47.964 Hz |

The port specifications Sp2 and t2 have been arbitrarily selected to give an equivocal acoustic mass to the port structure shown in FIG. 4 and disclosed in the co-pending application filed of even date herewith an entitled "PORTED LOUDSPEAKER SYSTEM AND METHOD WITH REDUCED AIR TURBULENCE." As taught in that co-pending application, smaller ports can be achieved with equivalent or better performances.

The three tuning ratios for the system of FIG. 4 in accordance with the principles of this invention are:

$Q_{tc}$=1.168

$Q_{mc}$=9.116

$Q_{tp}$=1.019

Constraining the values of the tuning ratios $Q_{tc}$, $Q_{mc}$ and $Q_{tp}$ within the values determined in accordance with the present invention, the system of FIG. 4 is characterized by unusually high values for moving mass and Bl product relative to driver cone size combined with unusually small enclosure volume relative to driver cone size and tuning frequency.

The bandpass system of FIG. 4 can also be used as a sub-woofer in a sub-woofer satellite system. Such an arrangement is illustrated in FIG. 5, showing a sub-woofer 27 and two smaller satellite loudspeakers 28 and 29. In accordance with the present invention, a preferred exemplary embodiment of a sub-woofer/satellite system wherein the sub-woofer is as described in connection with FIG. 4 has satellites which are each composed of four 4.5 inch drivers in a 0.610 ft.$^3$ sealed cabinet and having a $Q_{tc}$ of approximately 1.250. As pointed out previously, one aspect of the present invention applicable to such a system uses a $Q_{tc}$ of the sub-woofer less than 1.25, with the $Q_{tc}$ of the sub-woofer lying within the range of greater than 75% but less than 110% of the $Q_{tc}$ of the satellite loudspeakers.

Turning now to FIG. 6, there is shown a frequency response curve calculated for the bandpass woofer system discussed in connection with FIG. 4. The calculated response is generally within what is a good relationship between flat response, bandwidth and efficiency as previously discussed herein. Note the tilting of the response curve in FIG. 6 because fp for this example is less than fc, resulting in a tilting down of the curve on the high frequency side.

Figure 7:
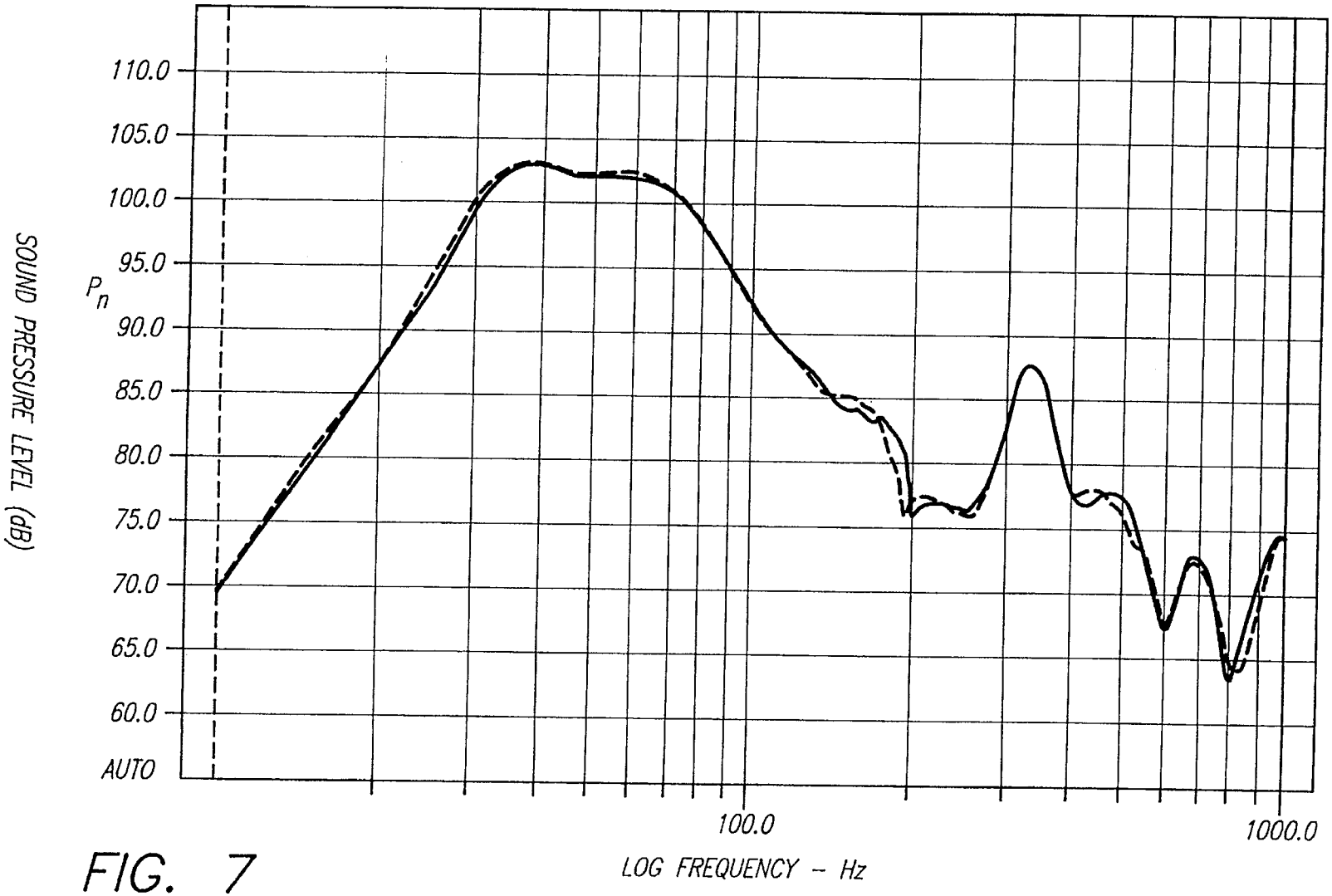
FIG. 7 is the measured response curve for the system of FIG. 4 taken with a microphone very close to the port in a large ground plane measurement room.

FIG. 7 shows the actual frequency response curve for the system of FIG. 4 taken with a microphone very close to the port in a large ground plane measurement room. The response curve of FIG. 7 has had 0.2 octave smoothing applied to eliminate measurement anomalies and has been equalized against the known response of the microphone and amplifier. As can be seen, the actual response curve agrees closely with the calculated response, and produces a very satisfactory output relationship among flat response, bandwidth and efficiency.

Although the various aspects of this invention have been shown and described in connection with what are presently preferred embodiments, clearly variations and departures from those preferred embodiments may be made without departing from the true spirit and scope of the invention.

I claim:

1. A bandpass woofer loudspeaker system comprising an enclosure having a partition dividing said enclosure into a first chamber and a second chamber, said first chamber being sealed and said second chamber having a passive radiating port communicating with air outside said enclosure, a driver comprising a transducer of the type having a diaphragm with front and rear sides, said driver mounted in the partition, and wherein said bandpass woofer loudspeaker system has a plurality of design variables including the following:

Mmd=moving mass of the driver in kilograms fc=the resonance of the driver in the first sealed chamber MAS=acoustic moving mass of the driver CAT=acoustic compliance of the driver suspension and the first sealed chamber R0=the acoustic resistance of a moving coil of the driver MAP2=the acoustic mass of the passive radiating port CA2=acoustic compliance of the second chamber having the passive radiating port and wherein there are defined a first tuning ratio $Q_{mc}$, a second tuning ratio $Q_{tc}$, and a third tuning ratio $Q_{tp}$ dependent upon the values of said variables as follows:

$$Q_{mc} = \frac{Mmd \cdot fc}{\text{kg} \cdot \text{sec}^{-1}}$$

$$Q_{tc} = \left( \frac{MAS}{CAT} \right)^{.5} \cdot \frac{1}{R0}$$

$$Q_{tp} = \left( \frac{MAP2}{CA2} \right)^{.5} \cdot \frac{1}{R0}$$

and wherein said bandpass loudspeaker system is constructed such that said variables result in said first tuning ratio $Q_{mc}$ having a value in excess of 5.0, said second tuning ratio $Q_{tc}$ falling within a range of from about 0.75 to about 1.25, and said third tuning ratio $Q_{tp}$ falling within a range of from about 0.75 to about 1.25.

2. A bandpass woofer loudspeaker system in accordance with claim 1 wherein the system has a further plurality of design variables including fp=resonance of port mass against vented chamber Sd=driver cone area Cms=compliance of driver suspension Re=driver voice coil DC resistance Bl=driver motor force factor V1=volume of sealed chamber V2=volume of vented chamber and wherein said bandpass loudspeaker system is constructed such that $Q_{tc}$, $Q_{tp}$, $Q_{mc}$ are specified or selected within the values set forth in claim 1, and the variables fc, fp, Sd, Cms and Re are also specified or selected, and the values for Bl, Mmd, V1, V2 and MAP2 area calculated using the first, second and third tuning ratios.

3. A bandpass woofer loudspeaker system in accordance with claim 1 wherein said passive radiating port comprises a vent tube having a varying cross sectional area which varies continuously from inside to outside the enclosure and which increases monotonically from a minimum value between the ends of the vent tube to a larger cross section at at least one end thereof, the varying cross sectional area of said vent tube being defined by an opening or port in the wall of the enclosure, at least a first disk or plate having an area larger than the minimum value, and means mounting said first disk or plate substantially perpendicular to and extending beyond said vent tube, and at a predetermined distance from said one end of the vent tube to configure said vent tube at said one end as an opening extending substantially around the periphery of said disk.

4. A bandpass woofer loudspeaker system in accordance with claim 3 including a flow guide attached to the at least first disk and substantially centered on the vent tube, said flow guide comprising an inverted circular funnel configuration having concave sides to essentially fill and block a stagnant, non-laminar air flow.

5. A bandpass woofer loudspeaker in accordance with claim 4 including a second disk having an area larger than the minimum value, and means mounting said second disk substantially perpendicular to and extending beyond said vent tube, and at a predetermined distance from an end of said vent tube opposite said one end to configure said vent tube at said opposite end as an opening extending substantially around the periphery of said second disk, and including a second flow guide attached to said second disk and substantially centered on the vent tube.

6. A bandpass woofer loudspeaker in accordance with any of claims 1 through 5, wherein said bandpass loudspeaker system is constructed such that the ratio of fc to fp lies within a range from about 0.75 to about 1.25.

7. A bandpass woofer loudspeaker in accordance with claim 6 wherein the tuning frequency fc is less than 50 Hz, and the driver cone area Sd is less than 0.050 square meters.

8. A bandpass woofer loudspeaker in accordance with claim 6 wherein the tuning frequency fc is less than 100 Hz, the driver cone area Sd is less than 0.050 square meters, and tuning ratio $Q_{mc}$ is greater than 10.

9. A bandpass woofer loudspeaker in accordance with claim 6 wherein the tuning ratio $Q_{mc}$ is greater than or equal to 1/10th the tuning frequency multiplied by the driver cone area divided by 0.050.

10. In combination, a bandpass woofer loudspeaker as defined in any of claims 1 through 5 configured to function as a sub-woofer, and combined with a plurality of satellite loudspeakers, and wherein the $Q_{tc}$ of the sub-woofer lies within a range of greater than 75% but less than 110% of a tuning ratio $Q_{tc}$ of the satellite loudspeakers.

11. A bandpass woofer loudspeaker in accordance with claim 10 wherein the tuning frequency fc is less than 50 Hz, and the driver cone area Sd is less than 0.050 square meters.

12. A bandpass woofer loudspeaker in accordance with claim 10 wherein the tuning frequency fc is less than 100 Hz, the driver cone area Sd is less than 0.050 square meters, and tuning ratio $Q_{mc}$ is greater than 10.

13. A bandpass woofer loudspeaker in accordance with claim 10 wherein the tuning ratio $Q_{mc}$ is greater than or equal to 1/10th the tuning frequency multiplied by the driver cone area divided by 0.050.

14. A bandpass woofer loudspeaker in accordance with claim 5 further including a connector extending along a central portion of the vent tube and connecting said first and second flow guides.

15. A bandpass woofer loudspeaker in accordance with any of claims 1 through 5 or 10 wherein the tuning frequency fc is less than 50 Hz, and the driver cone area Sd is less than 0.050 square meters.

16. A bandpass woofer loudspeaker in accordance with any of claims 1 through 5 or 14 wherein the tuning frequency fc is less than 100 Hz, the driver cone area Sd is less than 0.050 square meters, and tuning ratio $Q_{mc}$ is greater than 10.

17. A bandpass woofer loudspeaker in accordance with any of claims 1 through 5 or 14 wherein the tuning ratio $Q_{mc}$ is greater than or equal to 1/10th the tuning frequency multiplied by the driver cone area divided by 0.050.

18. A method of configuring a single-vented bandpass woofer loudspeaker system to operate satisfactorily in smaller enclosure volumes with only moderate loss of efficiency, wherein the loudspeaker system is of the type having an enclosure with a partition dividing the enclosure into a first chamber and a second chamber, with the first chamber being sealed and the second chamber having a passive radiating port communicating with air outside the enclosure, a partition mounting a driver of the moving coil transducer type, the bandpass woofer loudspeaker system having a plurality of design variables including the following:

Mmd=moving mass of the driver in kilograms fc=the resonance of the driver in the first sealed chamber MAS=acoustic moving mass of the driver CAT=acoustic compliance of the driver suspension and the first sealed chamber R0=the acoustic resistance of the moving coil of the driver MAP2=the acoustic mass of the passive radiating port CA2=acoustic compliance of the second chamber having the passive radiating port comprising the steps of defining a first tuning ratio $Q_{mc}$, a second tuning ratio $Q_{tc}$ and a third tuning ratio $Q_{tp}$ as follows:

$$Q_{mc} = \frac{Mmd \cdot fc}{\text{kg} \cdot \text{sec}^{-1}}$$

$$Q_{tc} = \left( \frac{MAS}{CAT} \right)^{.5} \cdot \frac{1}{R0}$$

$$Q_{tp} = \left( \frac{MAP2}{CA2} \right)^{.5} \cdot \frac{1}{R0}$$

and controlling the design variables such that $Q_{mc}$ has a value in excess of 5.0, $Q_{tc}$ has a value falling within a range of from about 0.75 to about 1.25, and $Q_{tp}$ has a value following within a range of from about 0.75 to about 1.25.

19. A method in accordance with claim 18 wherein the loudspeaker system is of the type having a plurality of further design variables including fp=resonance of port mass against vented chamber Sd=driver cone area Cms=compliance of driver suspension Re=driver voice coil DC resistance Bl=driver motor force factor V1=volume of sealed chamber V2=volume of vented chamber and comprising a step of specifying the values of $Q_{tc}$, $Q_{tp}$, and $Q_{mc}$ within the ranges set forth in claim 8, a step of specifying the variables fc, fp, Sd, Cms and Re, and further comprising a step of calculating the values for Bl, Mmd, V1, V2 and MAP2 using the first, second and third tuning ratios.

20. A method in accordance with claims 18 or 19 including the steps of controlling the tuning frequency fc to be less than 50 Hz and controlling the driver cone area Sd to be less than 0.050 square meters.

21. A method in accordance with claims 18 or 19 including the steps of controlling the tuning frequency fc to be less than 100 Hz, the driver cone area Sd to be less than 0.050 square meters, and the tuning ratio $Q_{mc}$ to be greater than 10.

22. A method in accordance with claims 18 or 19 including the step of controlling the tuning ratio $Q_{mc}$ to be greater than or equal to 1/10th the tuning frequency multiplied by the driver cone area divided by 0.050.

* * * * *